US006361409B1

(12) United States Patent
Vishwanathan et al.

(10) Patent No.: US 6,361,409 B1
(45) Date of Patent: Mar. 26, 2002

(54) POLYMERIC POLISHING PAD HAVING IMPROVED SURFACE LAYER AND METHOD OF MAKING SAME

(75) Inventors: Arun Vishwanathan, Wilmington; David L. Shidner, Newark, both of DE (US)

(73) Assignee: Rodel Holdings Inc., Williaminton, DE (US)

( * ) Notice: Subject to any disclaimer, the term of this patent is extended or adjusted under 35 U.S.C. 154(b) by 0 days.

(21) Appl. No.: 09/406,962

(22) Filed: Sep. 28, 1999

(51) Int. Cl.[7] ..... B24B 1/00
(52) U.S. Cl. ..... 451/56; 451/59; 451/60
(58) Field of Search ..... 451/56, 54, 36, 451/59, 60, 443, 444, 446

(56) References Cited

U.S. PATENT DOCUMENTS 3,706,691 A 12/1972 Duffy et al.
5,203,955 A 4/1993 Goldberg et al.
5,645,682 A * 7/1997 Skrovan ..... 156/636.1
5,698,455 A 12/1997 Hudson et al.
5,725,417 A 3/1998 Robinson
5,779,522 A * 7/1998 Walker et al. ..... 451/56
5,782,675 A * 7/1998 Southwick ..... 451/56
5,879,226 A * 3/1999 Robinson ..... 451/287
5,913,715 A * 6/1999 Kirchner et al. ..... 451/56
5,957,757 A 9/1999 Berman
5,958,796 A 9/1999 Prall et al.
6,012,968 A * 1/2000 Lofaro ..... 451/39

* cited by examiner

*Primary Examiner*—Timothy V. Eley
*Assistant Examiner*—Dung Van Nguyen
(74) *Attorney, Agent, or Firm*—Gerald K. Kita; Konrad Kaeding; Kenneth A. Benson

(57) ABSTRACT

A polishing pad made of polymeric material has an improved surface layer which is provided by treating a surface of the polishing pad with a chemical solvent. Solubility parameter is used to select a suitable chemical solvent. The treated polishing pad can be conditioned in substantially less time than an untreated pad.

25 Claims, No Drawings

POLYMERIC POLISHING PAD HAVING IMPROVED SURFACE LAYER AND METHOD OF MAKING SAME

BACKGROUND OF THE INVENTION

1. Field of the Invention

The invention relates to a polishing pad for use in a chemical-mechanical polishing operation, and in particular, to a polymeric polishing pad having a treated surface layer which improves polishing performance.

2. Discussion of Related Art

Semiconductor wafers which have integrated circuits fabricated thereon must be polished to produce an extremely smooth and flat wafer surface. One method for polishing a semiconductor wafer is chemical-mechanical polishing (CMP) wherein a chemically active slurry is applied to the wafer surface under pressure from a polishing pad.

The rate at which material is removed from the wafer surface is termed the polishing rate. Higher polishing rates are generally desired to reduce wafer polishing time and production costs. Polishing rates are initially low for an untreated polishing pad. As the polishing pad is broken in by use on successive wafers, polishing rates typically ramp up to a stable maximum level. After a while, the polishing rate tapers off and eventually declines to such an extent that the polishing pad must be renewed or replaced.

Conditioning is a technique wherein a polishing pad is treated to improve polishing performance. Conditioning generally involves making passes or sweeps over the polishing surface of the pad with an abrasive material. Polishing pads are generally pre-conditioned prior to initial use to achieve a stable polishing rate. Polishing pads are also post-conditioned after the polishing rate falls off in order to return the polishing rate to a higher level.

Pre-conditioning is especially necessary for molded polymeric polishing pads because these have a surface skin that must be disturbed or broken in order to expose material below the skin which exhibits a much higher polishing rate. It is desirable to reduce the time required for the pre-conditioning process in order to speed up wafer production and reduce costs. Similarly, it is also desirable to extend the time between post-conditioning operations and to reduce the duration of the post-conditioning process. Therefore, a polishing pad that requires less frequent conditioning and/or reduces the duration of the conditioning process would be advantageous.

SUMMARY OF THE INVENTION

The invention is a polishing pad comprising a polymeric material having a surface layer and a chemical solvent applied to the surface layer, wherein the surface layer is altered by the chemical solvent.

According to one aspect of the invention, the chemical solvent has a solubility parameter that differs by less than about twenty percent, more preferably by less than about ten percent, from a solubility parameter of the polymeric material.

One preferred chemical solvent for polyurethane polishing pads is N-methyl pyrrolidone (NMP).

Another preferred chemical solvent for polyurethane polishing pads is dimethyl formamide (DMF).

A method of treating a polishing pad made of polymeric material comprises contacting a surface of the polishing pad with a chemical solvent, wherein a layer of the polishing pad adjacent to the surface is altered. The chemical solvent may be integrated into a pre-conditioning liquid which is applied to the polishing pad during a pre-conditioning cycle prior to a polishing operation.

Alternatively, the chemical solvent may be integrated into a polishing slurry with which the polishing pad is used during a polishing operation.

DETAILED DESCRIPTION OF A PREFERRED EMBODIMENT

A polishing pad according to the invention is made of a polymeric material. The pad may be produced by any suitable process including thermoplastic injection molding, thermoset injection molding (often referred to as "reaction injection molding" or "RIM"), thermoplastic or thermoset injection blow molding, compression molding, casting, or any similar-type process in which a flowable material is positioned and solidified.

According to the invention, a polymeric polishing pad is treated with a chemical solvent which modifies a surface layer of the polishing pad. The polishing pad may be treated by simply contacting the polishing pad with the solvent. According to one method, the solvent is applied by wiping the polishing pad with a lint-free applicator that has been soaked in the solvent. The solvent is applied as a uniform wet coating to the surface of the polishing pad. Subsequently, the pad is air dried prior to use for CMP.

Alternatively, the solvent can be sprayed onto the surface of the polishing pad using a suitable spray gun or atomizer.

Alternatively, the solvent can be integrated into a pre-conditioning liquid that is applied to the polishing pad during a pre-conditioning cycle prior to a polishing operation.

Alternatively, the chemical solvent can be integrated into a polishing slurry which is then used along with the polishing pad during a polishing operation.

The chemical solvent must be able to modify or alter a surface layer of the polishing pad, yet be non-reactive with any polishing slurry and semiconductor wafer with which the polishing pad will be used.

In order to determine an effective chemical solvent for the polishing pad, one factor which should be considered is solubility parameter. Solubility parameter is a value relating to cohesive energy density of a solvent or a polymer. A solubility parameter can be calculated for each different solvent and each different polymer. The difference between the solubility parameters of two substances relates to how well the substances will mix. As the difference between solubility parameters is reduced, substances can be more readily mixed, and two substances having the same solubility parameter will be completely miscible. A discussion of methods for calculating solubility parameter and a table of solubility parameters for various solvents and polymers can be found in the Polymer Handbook, second edition, Brandrup and Immergut editors, Interscience Publishers, John Wiley and Sons, 1975, pages 341–368.

According to the invention, a suitable solvent for application to a polymeric polishing pad should have a solubility parameter that differs by less than about twenty percent, more preferably by less than about ten percent, from the solubility parameter of the polishing pad material. preferred polymeric polishing pad of the present invention is made of a polyurethane material having a solubility parameter of approximately 10 $(cal/cm^3)^{1/2}$. Preferred solvents for use with this polishing pad are N-methyl pyrrolidone (NMP) and dimethyl formamide (DMF), which have solubility parameters of 11.3 and 12.1 $(cal/cm^3)^{1/2}$, respectively.

In addition to solubility parameter, another factor which should be considered is hydrogen bonding capability. Polymeric polishing pads are best treated with chemical solvents having a medium to low hydrogen bonding capability.

Polishing pads are generally pre-conditioned prior to use. This pre-conditioning creates or augments the micro-texture of the pad surface. During use, the micro-texture can experience unwanted plastic flow and can be fouled by debris. As a result, polishing pads are generally post-conditioned periodically during their useful life to regenerate an optimal micro-texture.

Solvent treatment according to the invention softens the surface layer of the polishing pad. The softer surface makes the pad easier to condition and can reduce both the pre-conditioning and post-conditioning time significantly.

An optimum micro-texture is more easily achieved, thereby leading to higher polishing rates and increased uniformity across a polished wafer surface.

EXAMPLE

A test was conducted to determine the effect of polishing pad treatment on material removal rate. In this test, treated and untreated OXP3000 polishing pads manufactured by Rodel, Inc., of Newark, DEL. were pre-conditioned by sweeps of a conditioning apparatus across each pad. Prior to pre-conditioning, the treated pad received an application of NMP at 50% concentration in de-ionized water. The NMP solution was applied by soaking a cheesecloth in the solution and wiping the cheesecloth over the polishing surface of the pad so as to wet the polishing surface.

The following Table shows material removal rates as a function of the number of pre-conditioning sweeps for each polishing pad.

TABLE

Removal Rate as a function of the number of pre-conditioning sweeps

| # of Sweeps | Removal Rate: Untreated Pad | Removal Rate: Treated Pad |
|---|---|---|
| 0 | 2340 | 2280 |
| 30 | 2365 | 2470 |
| 60 | 2430 | 2555 |
| 90 | 2445 | 2530 |
| 120 | 2465 | 2520 |
| 150 | 2490 | 2545 |
| 180 | 2535 | 2585 |
| 210 | 2600 | 2605 |
| 240 | 2600 | 2630 |
| 270 | 2550 | 2655 |
| 95% of the Removal rate of the last three runs | 2454 | 2499 |

The Table illustrates that the treated pad achieves 95% of its final removal rate after only 30 sweeps, while the untreated pad requires 90 sweeps to achieve 95% of its final removal rate. This translates into a significant saving in time that is required for pre-conditioning.

As a further benefit, the soft surface layer of a treated polishing pad reduces scratches and light point defects (LPD) on polished wafers compared to polishing with an untreated pad. Laboratory testing has shown that total defects produced by a treated pad are less than 2% of the total defects produced by an untreated pad.

Another beneficial aspect of solvent treatment is increased hydrophilicity of the surface layer of the polishing pad. Hydrophilicity can be determined by measuring the contact angle which de-ionized water exhibits on the surface of the polishing pad. Lower contact angles are associated with increased hydrophilicity, i.e., better wetting of the surface which promotes slurry distribution across the polishing pad and improved polishing performance.

In one example, contact angles were measured for de-ionized water on the surface of OXP3000 polishing pads. The contact angle for an untreated polishing pad was 111°. For a treated pad, the contact angle was 82°. After the treated pad was used for polishing, the contact angle was 79°, which shows that the treated surface does not deteriorate after polishing.

It has been found that solvent treatment according to the invention modifies a surface layer which is only about 5% of the thickness of the polishing pad. Thus, the bulk modulus and the stiffness of the polishing pad are not significantly reduced, thereby having no detrimental effect on the planarity of polished wafers compared with an untreated pad.

The invention having been disclosed, a number of variations will now become apparent to those skilled in the art. Whereas the invention is intended to encompass the foregoing preferred embodiments as well as a reasonable range of equivalents, reference should be made to the appended claims rather than the foregoing discussion of examples, in order to assess the scope of the invention in which exclusive rights are claimed.

We claim:

1. A softened polishing pad for polishing a semiconductor wafer, the polishing pad comprising: a material of the polishing pad having a solubility parameter, the material of the polishing pad being miscible with a solvent having a solubility parameter that is less than the solubility parameter of the material of the polishing pad, and a layer of the polishing pad adjacent to a surface of the polishing pad, the material of the polishing pad being in said layer and having been softened by the solvent.

2. A softened polishing pad as recited in claim 1, and further comprising: said solvent having a solubility parameter that differs from the solubility parameter of the material of the polishing pad in a range from about 0 to about 20%.

3. A softened polishing pad as recited in claim 1 wherein, the material of the polishing pad is polyurethane and the solvent is N-methyl pyrrolidone.

4. A softened polishing pad as recited in claim 1 wherein, the material of the polishing pad is polyurethane and the solvent is dimethyl formamide.

5. softened polishing pad as recited in claim 1 wherein, the solvent is integrated with a polishing slurry applied to the pad.

6. A softened polishing pad as recited in claim 1 wherein, the solvent is nonreactive with a polishing slurry.

7. A softened polishing pad as recited in claim 1 wherein, the solvent is integrated with a pre-conditioning liquid applied to the polishing pad.

8. A softened polishing pad as recited in claim 1 wherein, the solvent has a solubility parameter that differs by less than about twenty percent from the solubility parameter of the material of the polishing pad.

9. A softened polishing pad as recited in claim 1 wherein, the solvent has a solubility parameter that differs by less than about ten percent from the solubility parameter of the material of the polishing pad.

10. A method for providing a polishing pad for polishing a semiconductor wafer, comprising the steps of:

contacting a surface of a polishing pad with a solvent that is nonreactive with the semiconductor wafer, and softening a layer of the polishing pad adjacent to the surface of the polishing pad by the solvent having a solubility parameter that is less than the solubility parameter of a material of the polishing pad that is in said layer, such that the material of the polishing pad is softened by being miscible with said solvent.

11. A method as recited in claim 10 wherein, the step of softening a layer of the polishing pad further comprises the step of: softening the layer of the polishing pad by the solvent having a solubility parameter that differs from the solubility parameter of the material of the polishing pad in a range from about 0 to about 20%.

12. A method as recited in claim 10, and further comprising the steps of:

integrating the solvent with a polishing slurry, and applying the polishing slurry to the polishing pad during polishing of the semiconductor wafer.

13. A method as recited in claim 10, and further comprising the steps of:

integrating the solvent with a pre-conditioning liquid, and applying the pre-conditioning liquid to the polishing pad prior to conditioning the polishing pad.

14. A method as recited in claim 10 wherein, the step of softening a layer of the polishing pad, further comprises the step of: softening the layer of the polishing pad by the solvent having a solubility parameter that differs by less than about ten percent from the solubility parameter of the material of the polishing pad.

15. A method as recited in claim 10 wherein, the step of softening a layer of the polishing pad, further comprises the step of softening the layer of the polishing pad by the solvent having a solubility parameter that differs by less than about twenty percent from the solubility parameter of the material of the polishing pad.

16. A method for providing a polishing pad for polishing a semiconductor wafer, comprising the steps of:

contacting the surface of a polishing pad with a solvent that is nonreactive with the semiconductor wafer, and softening a layer of the polishing pad adjacent to the surface of the polishing pad by the solvent being N-methyl pyrrolidone having a solubility parameter that is less than the solubility parameter of a material of the polishing pad that is in said layer, such that the material of the polishing pad is softened by being miscible with said solvent.

17. A method for providing a polishing pad for polishing a semiconductor wafer, comprising the steps of:

contacting the surface of a polishing pad with a solvent that is nonreactive with the semiconductor wafer, and softening a layer of the polishing pad adjacent to the surface of the polishing pad by the solvent being dimethyl formamide having a solubility parameter that is less than the solubility parameter of a material of the polishing pad that is in said layer, such that the material of the polishing pad is softened by being miscible with said solvent.

18. A method for treating a polishing pad for polishing a semiconductor wafer using the polishing pad and a polishing slurry, comprising the steps of:

contacting the surface of the polishing pad with a solvent that is nonreactive with the polishing slurry and the semiconductor wafer, and softening a layer adjacent to the surface of the polishing pad and rendering the layer more hydrophilic by softening a material that is in the layer by the solvent having a solubility parameter less than the solubility parameter of said material.

19. A method as recited in claim 18 wherein, the step of softening a layer of the polishing pad and rendering the layer more hydrophilic further comprises the step of: softening the layer of the polishing pad by the solvent having a solubility parameter that differs from the solubility parameter of said material of the polishing pad in a range from about 0 to about 20%.

20. A method as recited in claim 18, and further comprising the steps of:

integrating the solvent with a polishing slurry, and applying the polishing slurry to the polishing pad during polishing of the semiconductor wafer.

21. A method as recited in claim 18, and further comprising the steps of:

integrating the solvent with a pre-conditioning liquid, and applying the pre-conditioning liquid to the polishing pad prior to conditioning the polishing pad.

22. A method as recited in claim 18 wherein, the step of softening a layer of the polishing pad and rendering the layer more hydrophilic, further comprises the step of:

softening the layer of the polishing pad and rendering the layer more hydrophilic by the solvent having a solubility parameter that differs by less than about ten percent from the solubility parameter of said material of the polishing pad.

23. A method as recited in claim 18 wherein, the step of softening a layer of the polishing pad and rendering the layer more hydrophilic, further comprises the step of: softening the layer of the polishing pad and rendering the layer more hydrophilic by the solvent having a solubility parameter that differs by less than about twenty percent from the solubility parameter of said material of the polishing pad.

24. A method for treating a polishing pad for polishing a semiconductor wafer using the polishing pad and a polishing slurry, comprising the steps of:

contacting the surface of the polishing pad with a solvent that is nonreactive with the polishing slurry and the semiconductor wafer, and softening a layer adjacent to the surface of the polishing pad and rendering the layer more hydrophilic by the solvent being N-methyl pyrrolidone having a solubility parameter less than the solubility parameter of a material of the polishing pad that is in the layer, said material being miscible with the solvent.

25. A method for treating a polishing pad for polishing a semiconductor wafer using the polishing pad and a polishing slurry, comprising the steps of:

contacting the surface of the polishing pad with a solvent that is nonreactive with the polishing slurry and the semiconductor wafer, and softening a layer adjacent to the surface of the polishing pad and rendering the layer more hydrophilic by the solvent being dimethyl formamide having a solubility parameter less than the solubility parameter of a material of the polishing pad that is in the layer, said material being miscible with the solvent.

* * * * *